US007581980B2

(12) United States Patent
Chiu et al.

(10) Patent No.: US 7,581,980 B2
(45) Date of Patent: Sep. 1, 2009

(54) MICRO USB SOCKET CONNECTOR

(75) Inventors: Wen Ta Chiu, Taipei Hsien (TW); Ming Hui Yen, Taipei Hsien (TW); Chen An Wu, Taipei Hsien (TW)

(73) Assignee: Chant Sincare Co., Ltd., Hsi Chih, Taipei Hsien (TW)

( * ) Notice: Subject to any disclaimer, the term of this patent is extended or adjusted under 35 U.S.C. 154(b) by 0 days.

(21) Appl. No.: 12/007,725

(22) Filed: Jan. 15, 2008

(65) Prior Publication Data

US 2009/0098746 A1 Apr. 16, 2009

(30) Foreign Application Priority Data

Oct. 12, 2007 (TW) ..... 96217055 U
Nov. 29, 2007 (TW) ..... 96220195 U

(51) Int. Cl.
*H01R 13/58* (2006.01)

(52) U.S. Cl. ..... 439/466

(58) Field of Classification Search ..... 439/630–632, 439/752, 79, 326, 466
See application file for complete search history.

(56) References Cited

U.S. PATENT DOCUMENTS 7,303,442 B2 * 12/2007 Fan ..... 439/630

* cited by examiner

*Primary Examiner*—Jean F Duverne
(74) *Attorney, Agent, or Firm*—Bacon & Thomas, PLLC

(57) ABSTRACT

A USB socket connector includes a plastic core member, which has metal terminals embedded therein and a constraint member, for example, a raised portion, and a metal casing, which houses the plastic core member and has a constraint device, for example, notch that receives the constraint device of the plastic core member to hold the plastic core member in position upon insertion of the plastic core member into the casing, and two rear extension arms that are bent into shape and stopped against the back side of the plastic core member to hold down the plastic core member firmly in place after insertion of the plastic core member into the metal casing.

17 Claims, 10 Drawing Sheets

MICRO USB SOCKET CONNECTOR

BACKGROUND OF THE INVENTION (a) Field of the Invention

The present invention relates to a USB (Universal Serial Bus) connector and more particularly, to a micro USB socket connector, which comprises a plastic core member having multiple metal terminals embedded therein and a metal casing that houses the plastic cover member, wherein the plastic core member has a constraint device, for example, a raised portion forced into engagement with a matching constraint device, for example, a notch of the metal casing, and the metal casing has two rear extension arms bent inwards or downwards to hold down the plastic cover member.

(b) Description of the Prior Art

A micro USB (Universal Series Bus) connector has a dimension smaller than a mini USB connector. Micro USB is a new generation specification of mini USB, having a dimension reduced by 60% when compared to mini USB. For the advantages of lower profile and high power characteristics, micro USB is practical for use in small electronics (such as cell phone, digital camera, PDA, or mobile music player to provide a high-speed data transmission or battery charging function.

In actual use, a micro USB connector is frequently plugged and unplugged. Therefore, a micro USB connector must be more durable than a mini USB connector to pass the more critical twist test than ever before, which means the capability of being plugged and unplugged of a micro USB must be over 10,000 times.

A regular micro USB socket connector is generally comprised of a metal casing, a plastic core member mounted in the metal casing, and a plurality of metal terminals bonded to the plastic core member. When in use, a micro USB socket connector is bonded to a circuit board. After a certain number of times in plugging and unplugging, both the connection between the metal casing and the circuit board and that between the plastic core member and the metal casing may be loosened, resulting in a connection error.

SUMMARY OF THE INVENTION

The present invention has been accomplished under the circumstances in view. According to one aspect of the present invention, the micro USB socket connector is comprised of a metal casing and a plastic core member mounted inside the metal casing. The plastic core member has metal terminals embedded therein, and a constraint device at the top side near the back. The metal casing has a constraint device, which well engages the constraint device of the plastic core member to hold the plastic core member in position when the plastic cover member is inserted into the metal casing, and two rear extension arms that are bent into shape and stopped against the back side of the plastic core member to hold down the plastic core member firmly in place after insertion of the plastic core member into the metal casing.

According to another aspect of the present invention, the constraint device of the plastic casing is a raised portion protruded from the top wall, and the constraint device of the metal casing is a notch disposed at the rear side of the top wall for receiving the raised portion of the plastic casing.

According to still another aspect of the present invention, the extension arms can be extended from the top wall, bottom wall, or two opposite lateral sidewalls of the metal casing in longitudinal or transverse direction. The extension arms can be short arms for attaching to the back side of the plastic core member to hold down the plastic core member firmly in place. Alternatively, the extension arms can be long arms each having the free end terminating in a plug portion for bonding to a mounting through hole on a circuit board.

According to still another aspect of the present invention, the metal casing has at least one bonding strip for bonding to the grounding terminal of the circuit to provide excellent grounding function.

According to still another aspect of the present invention, the metal casing has bonding strips respectively downwardly extending from the two opposite lateral sidewalls thereof for plugging into respective mounting through holes on a circuit board for bonding.

DETAILED DESCRIPTION OF THE PREFERRED EMBODIMENTS

Figure 1:
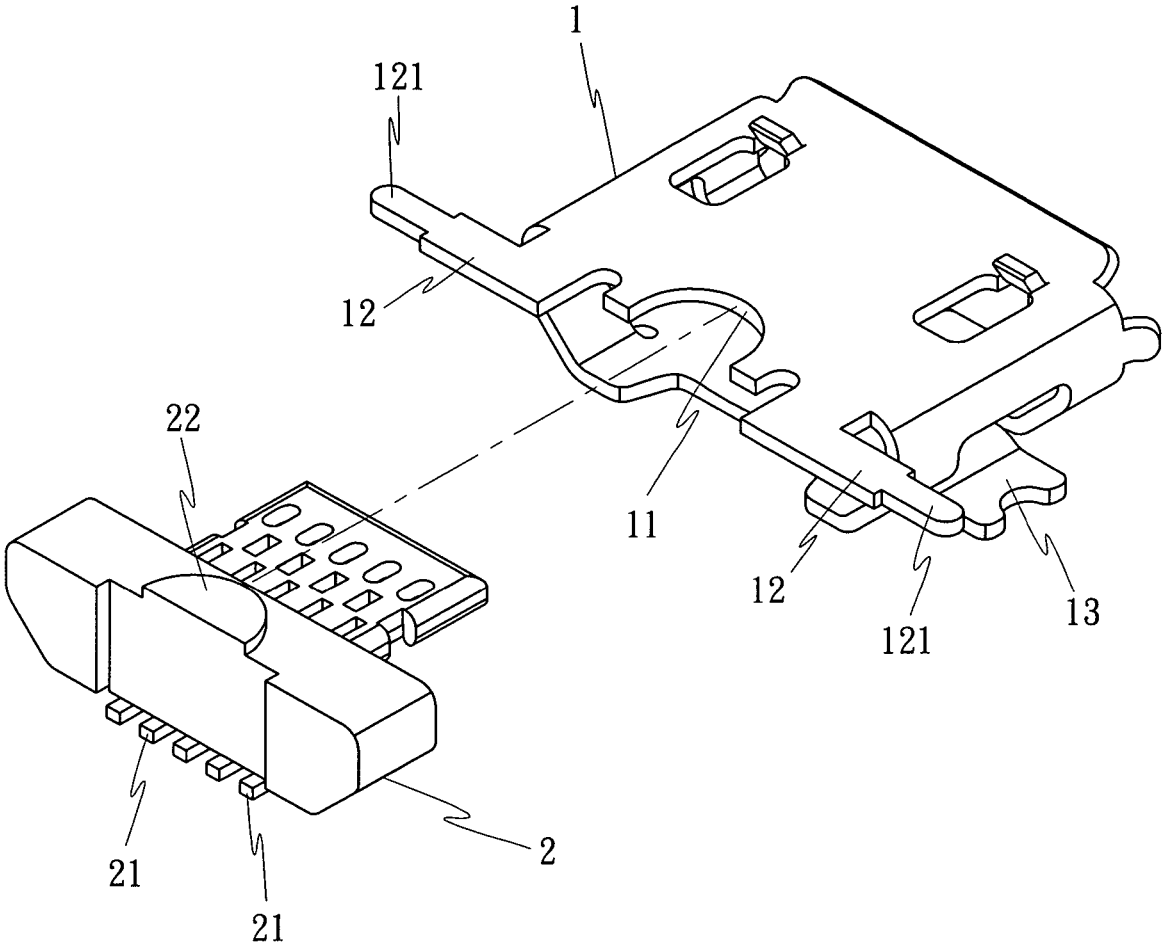
FIG. 1 is an exploded view of a micro USB socket connector in accordance with a first embodiment of the present invention.
Figure 2:
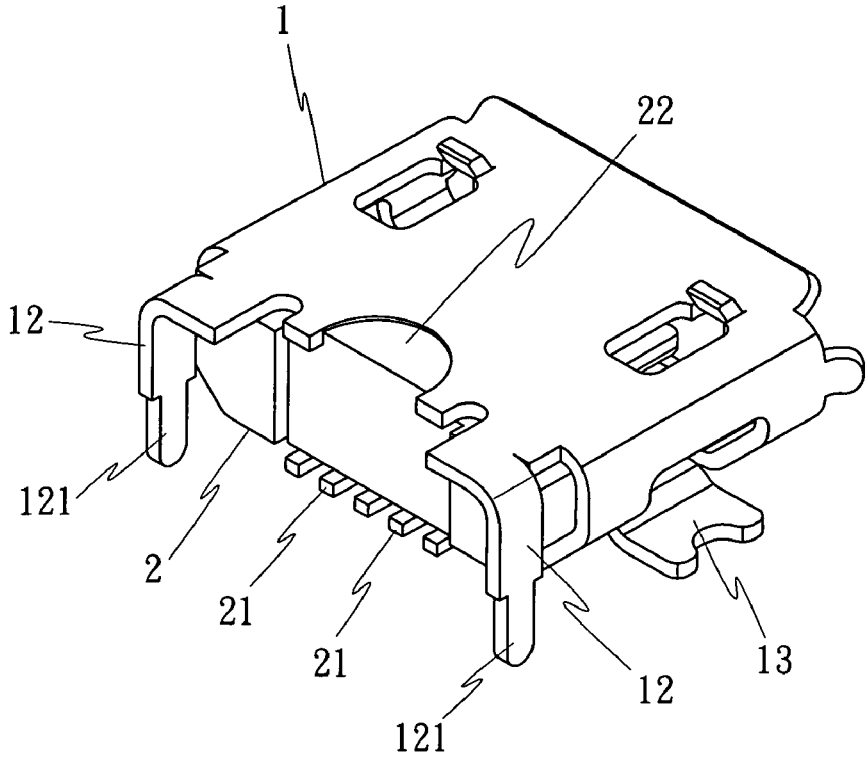
FIG. 2 is an elevational assembly view of the micro USB socket connector in accordance with the first embodiment of the present invention.
Figure 3:
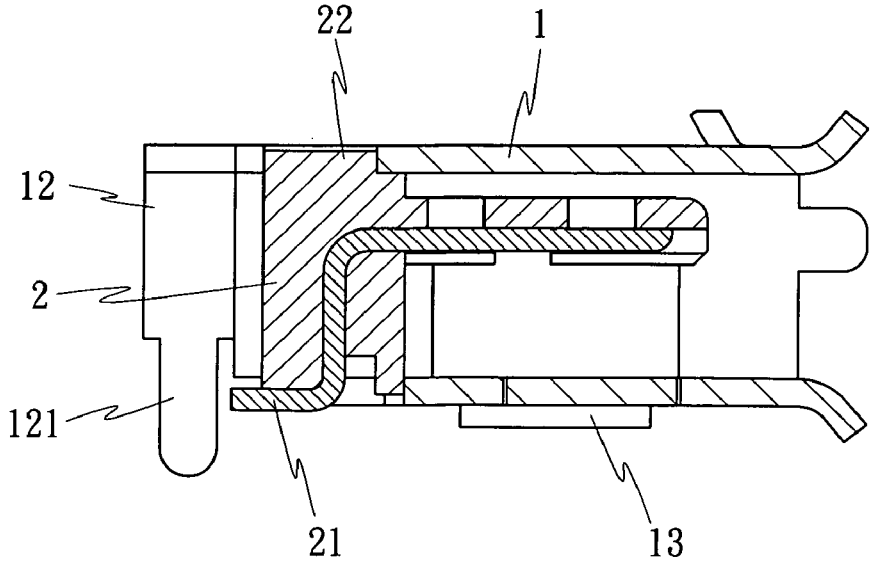
FIG. 3 is a sectional view of the micro USB socket connector in accordance with the first embodiment of the present invention.

Referring to FIGS. 1~3, a micro-USB socket connector in accordance with a first embodiment of the present invention is shown comprised of a metal casing 1 and a plastic core member 2.

The metal casing 1 is a hollow metal holder member having a front open side and a rear open side. The plastic cover member 2 is insertable through the rear open side into the inside of the metal casing 1. The metal casing 1 has a first constraint device 11 at one of the top and bottom walls thereof, for example, at the top wall, two rear extension arms 12 at two opposite lateral sides of the first constraint device 11. According to this embodiment, the first constraint device 11 is a notch at the rear side of the top wall of the metal casing 1. The front open side of the metal casing 1 is adapted for receiving a micro USB plug connector (not shown).

The plastic core member 2 is an electrically insulative block member having a plurality of metal terminals 21 molded therein. The plastic core member 2 has a second constraint device 22 at one side, for example, the top side. According to this embodiment, the second constraint device 22 is a raised portion protruded from the top side of the plastic core member 2 and fitting the fits the first constraint device (notch) 11 of the metal casing 1.

When the plastic core member 2 is inserted through the rear open side into the inside of the metal casing 1, the second constraint device (raised portion) 22 is fitted into the first constraint device (notch) 11 of the metal casing 1. After insertion of the plastic core member 2 into the inside of the metal casing 1, the two extension arms 12 are bent downwards and stopped against the plastic core member 2 to secure the plastic core member 2 firmly inside the metal casing 1.

As illustrated in FIGS. 1~3, the extension arms 12 extend transversely from the top wall of the metal casing 1 in reversed directions. After insertion of the plastic core member 2 into the inside of the casing 1, the two extension arms 12 are bent vertically downwards and stopped against the rear side of the plastic core member 2. By means of the engagement between the constraint device (raised portion) 22 of the plastic cover member 2 and the first constraint device (notch) 11 of the metal casing 1 and the constraint of the extension arms 12 of the metal casing 1, the plastic core member 2 is secured to the inside of the casing 1 firmly in place.

Further, the extension arms 12 each have a free end terminating in a reduced plug portion 121 for plugging into a respective mounting through hole on a circuit board (not shown) to secure the micro USB socket connector to the circuit board firmly in place. After installation in the circuit board, the micro USB socket connector will be installed firmly to the circuit board, and can pass a critical twist test.

The metal casing 1 further comprises at least one bonding strip 13. During installation of the micro USB socket connector in a circuit board, the bonding strip 13 is bonded to a grounding terminal of the circuit board. Therefore, the micro USB socket connector of the invention has excellent grounding function.

Figure 4:
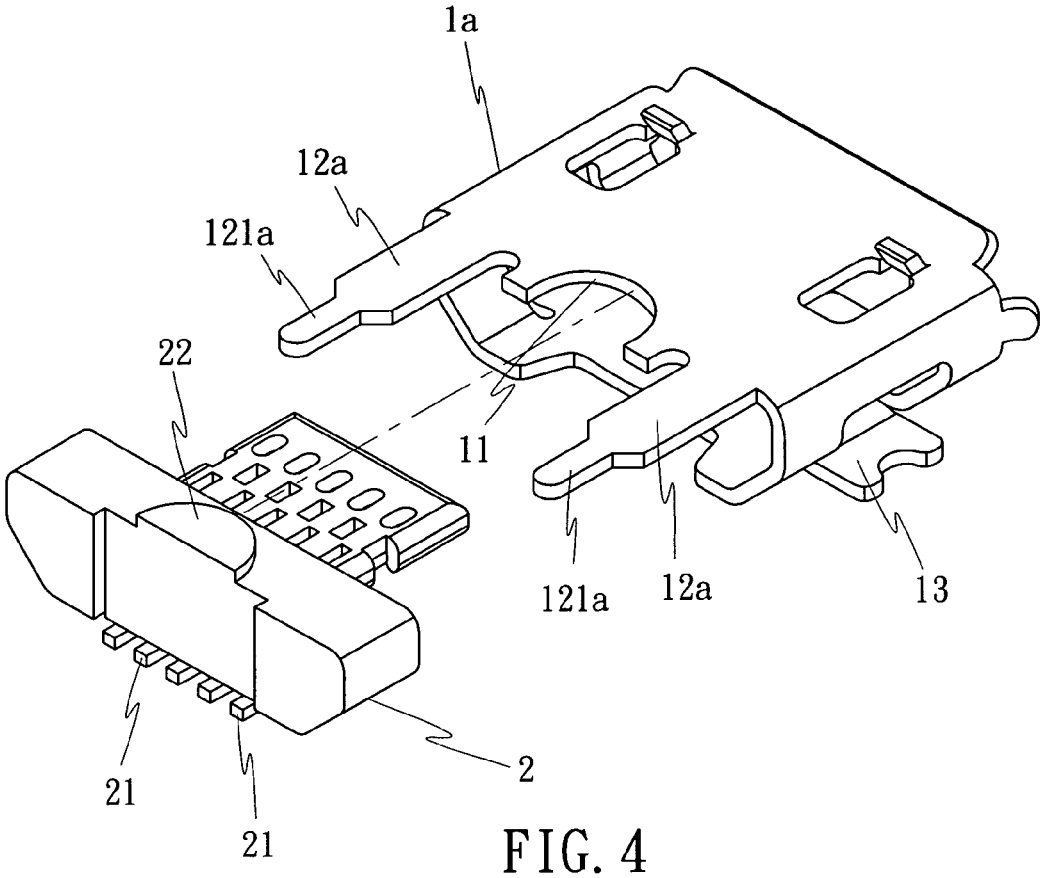
FIG. 4 is an exploded view of a micro USB socket connector in accordance with a second embodiment of the present invention.
Figure 5:
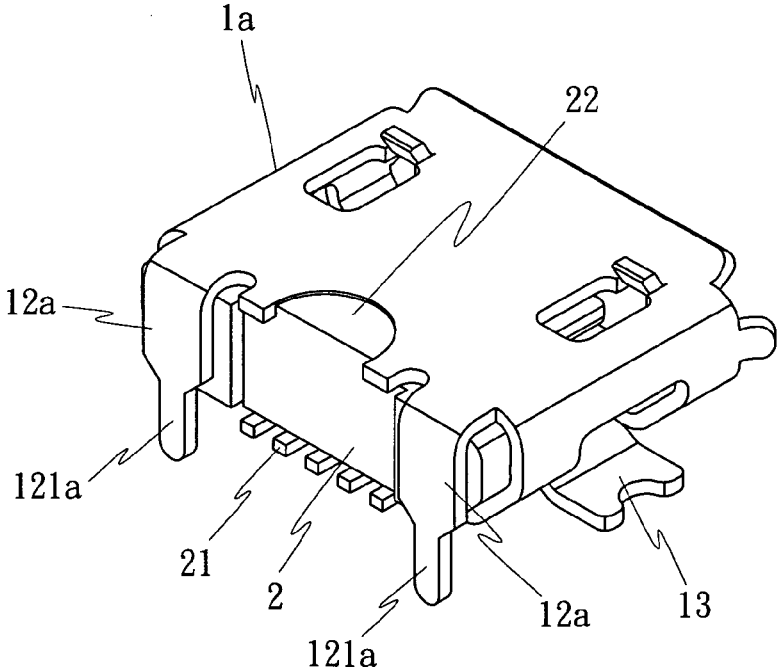
FIG. 5 is an elevational assembly view of the micro USB socket connector in accordance with the second embodiment of the present invention.

FIGS. 4 and 5 show a micro USB socket connector in accordance with a second embodiment of the present invention. According to this second embodiment, the micro USB socket connector is comprised of a metal casing 1*a* and a plastic core member 2. The plastic cover member 2 of this second embodiment is same as the aforesaid first embodiment. The metal casing 1*a* of this second embodiment is substantially similar to the metal casing 1 of the aforesaid first embodiment with the exception of the extending direction of the extension arms 12*a*. According to this second embodiment, the extension arms 12*a* extend backwardly from the top wall of the metal casing 1*a* in longitudinal direction (the direction extending through the front open side and rear open side of the metal casing), each having a free end terminating in a reduced plug portion 121*a*. After insertion of the plastic core member 2 into the inside of the casing 1*a*, the two extension arms 12*a* are bent vertically downwards and stopped against the rear side of the plastic core member 2.

In the aforesaid first and second embodiments, the extension arms 12 or 12*a* have a certain length. Alternatively, the extension arms 12 or 12*a* can be made relatively shorter.

Figure 6:
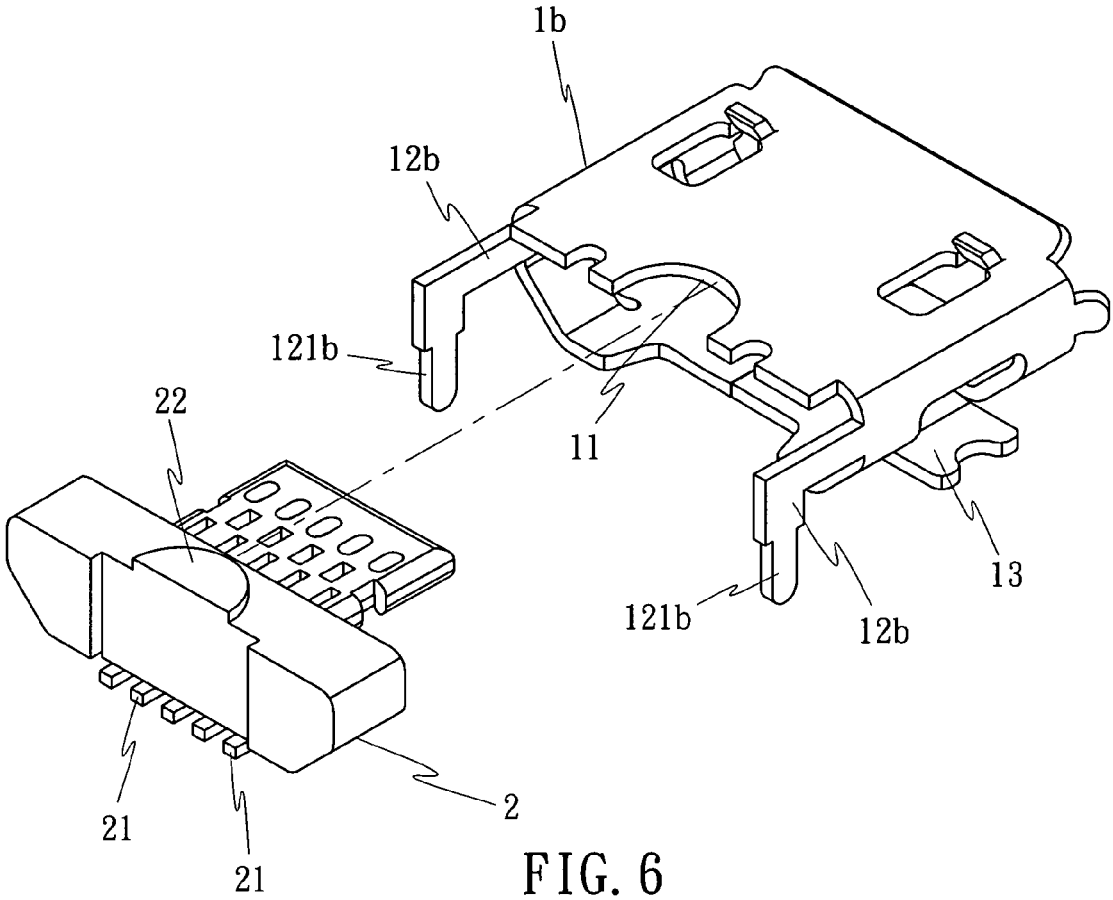
FIG. 6 is an exploded view of a micro USB socket connector in accordance with a third embodiment of the present invention.
Figure 7:
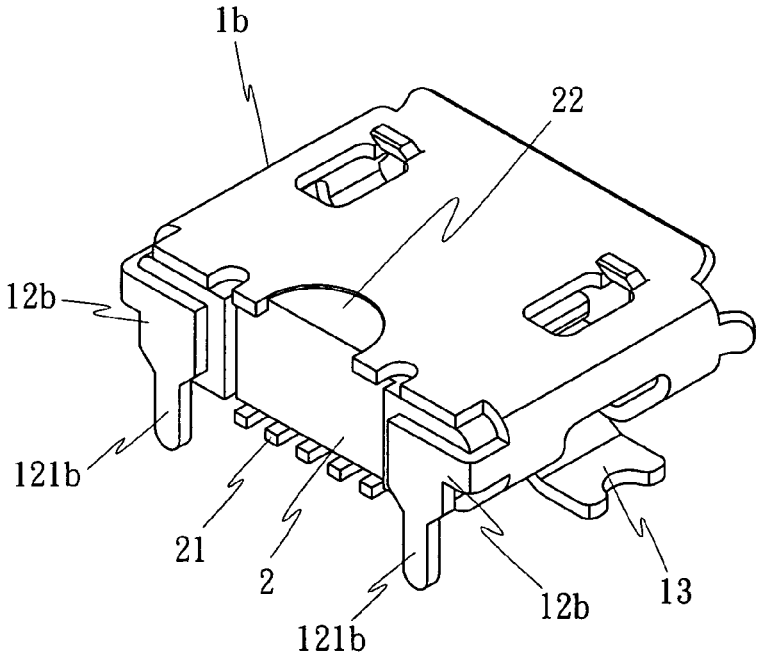
FIG. 7 is an elevational assembly view of the micro USB socket connector in accordance with the third embodiment of the present invention.

FIGS. 6 and 7 show a micro USB socket connector in accordance with a third embodiment of the present invention. According to this third embodiment, the micro USB socket connector is comprised of a metal casing 1*b* and a plastic core member 2. The plastic cover member 2 of this third embodiment is same as the aforesaid first embodiment. The metal casing 1*b* of this third embodiment is substantially similar to the metal casing 1 of the aforesaid first embodiment with the exception of the configuration of the extension arms 12*b*. According to this third embodiment, the extension arms 12*b* are L-shaped bars respectively and backwardly from two opposite lateral sidewalls of the metal casing 1*b*, each having a free end terminating in a reduced plug portion 121*b*. After insertion of the plastic core member 2 into the inside of the casing 1*b*, the two extension arms 12*b* are horizontally bent inwards toward the center of the rear open side of the metal casing 1*b* and stopped against the rear side of the plastic core member 2.

Figure 8:
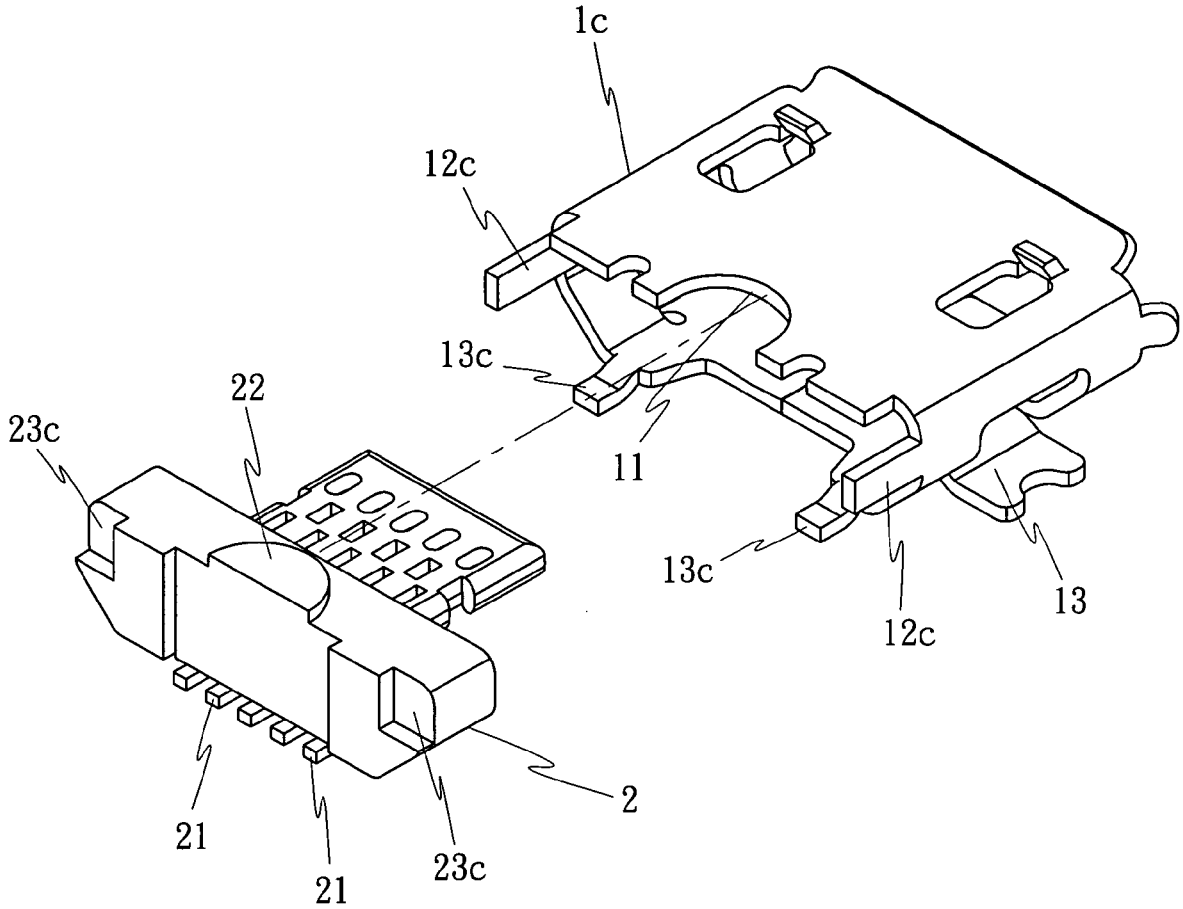
FIG. 8 is an exploded view of a micro USB socket connector in accordance with a fourth embodiment of the present invention.
Figure 9:
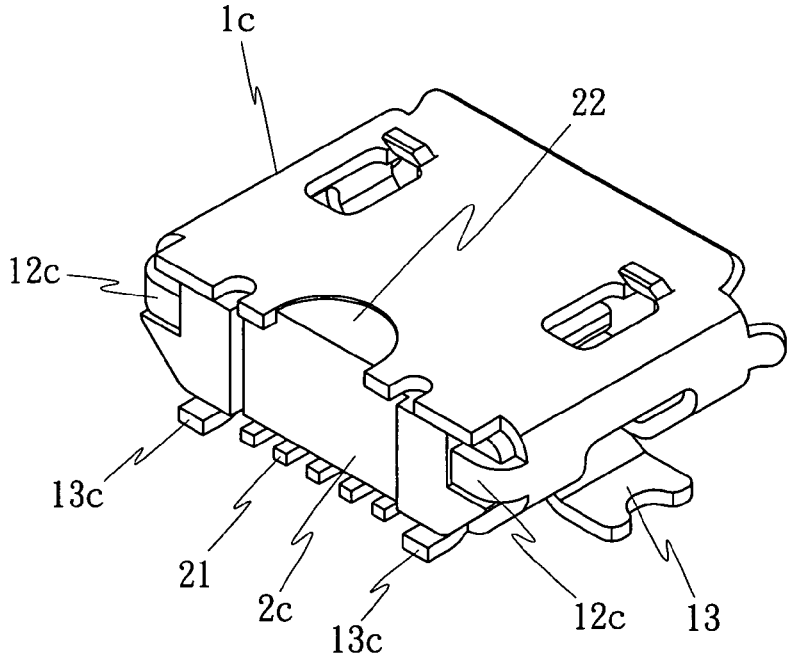
FIG. 9 is an elevational assembly view of the micro USB socket connector in accordance with the fourth embodiment of the present invention.

FIGS. 8 and 9 show a micro USB socket connector in accordance with a fourth embodiment of the present invention. According to this fourth embodiment, the micro USB socket connector is comprised of a metal casing 1*c* and a plastic core member 2. The metal casing 1*c* of this fourth embodiment comprises two short extension arms 12*c* respectively backwardly extending from the two opposite lateral sidewalls, and two mounting rods 13*c* respectively backwardly extending from the bottom wall. The plastic core member 2 of this fourth embodiment has two locating grooves 23*c* bilaterally disposed at the rear side. After insertion of the plastic core member 2 through the rear open side into the inside of the metal casing 1*c* to force second constraint device (raised portion) 22 into engagement with the first constraint device (notch) 11 of the metal casing 1*c*, the two short extension arms 12*c* are respectively bent inwards and engaged into the locating grooves 23*c* of the plastic core member 2, and the bonding strip 13 and mounting rods 13*c* are respectively bonded to a circuit board (not shown).

Figure 10:
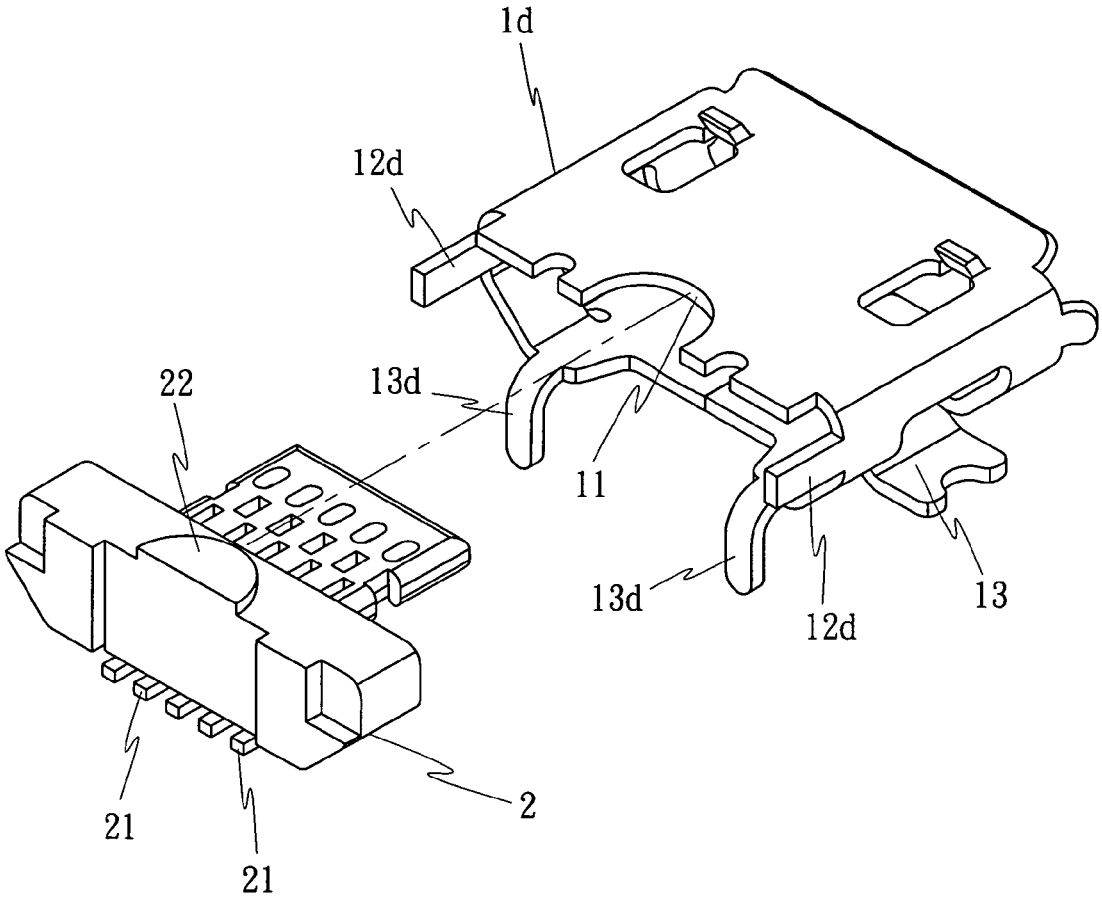
FIG. 10 is an exploded view of a micro USB socket connector in accordance with a fifth embodiment of the present invention.
Figure 11:
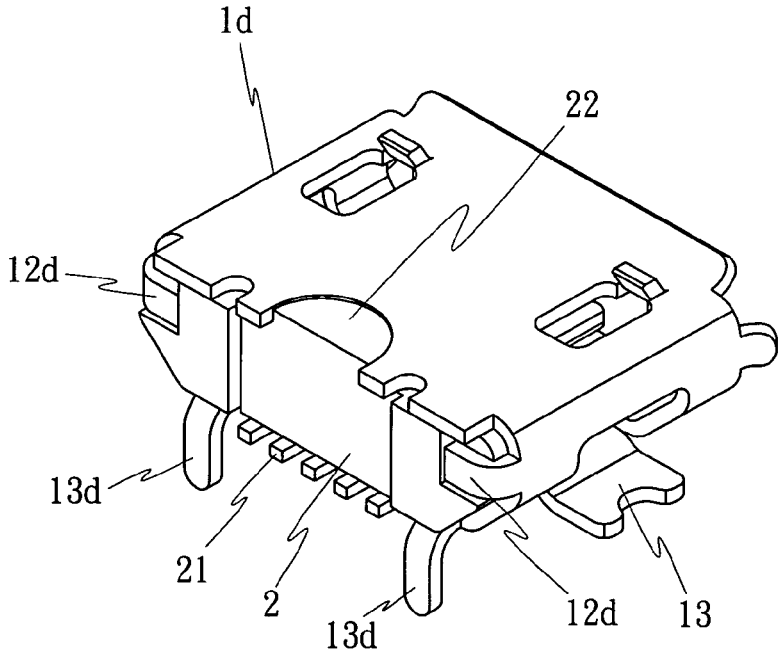
FIG. 11 is an elevational assembly view of the micro USB socket connector in accordance with the fifth embodiment of the present invention.

FIGS. 10 and 11 show a micro USB socket connector in accordance with a fifth embodiment of the present invention. According to this fifth embodiment, the micro USB socket connector is comprised of a metal casing 1*d* and a plastic core member 2. The plastic core member 2 of this fifth embodiment is same as the aforesaid fourth embodiment. The metal casing 1*d* of this fifth embodiment comprises two short extension arms 12*d* respectively backwardly extending from the two opposite lateral sidewalls for securing the plastic core member 2 to the inside of the metal casing 1*d*, and two angled mounting rods 13*d* curved downwards from the rear side of the bottom wall for bonding to a respective mounting through hole on a circuit board (not shown).

Figure 12:
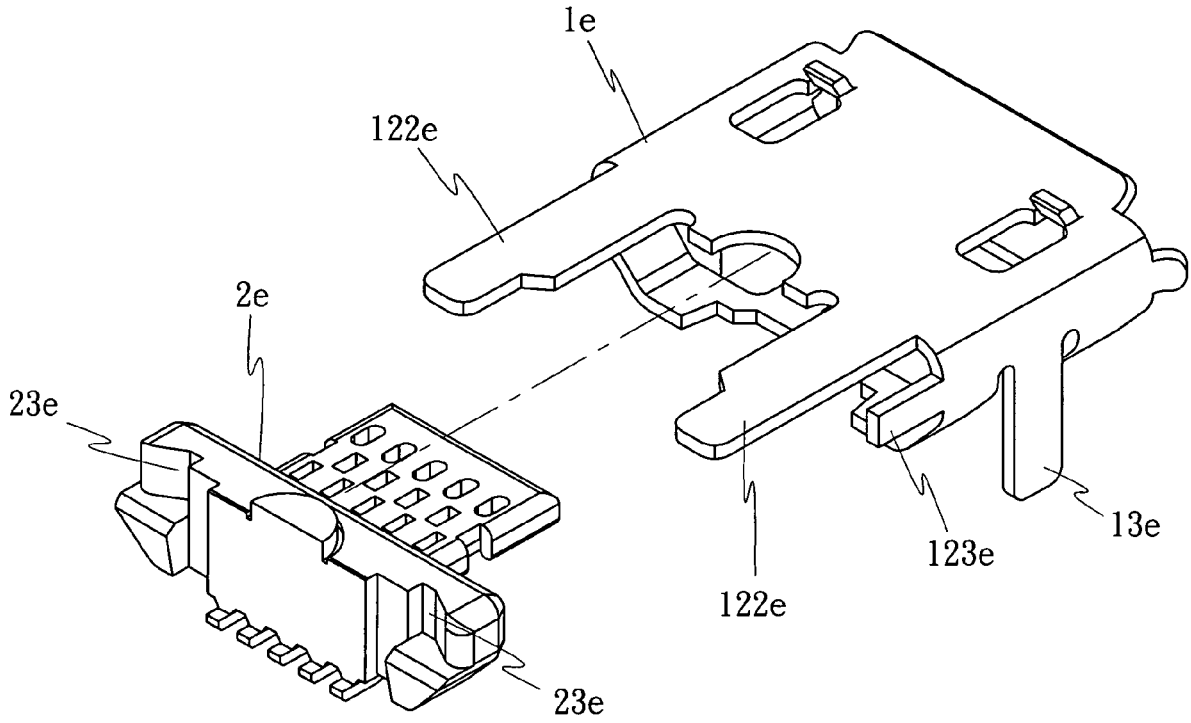
FIG. 12 is an exploded view of a micro USB socket connector in accordance with a sixth embodiment of the present invention.
Figure 13:
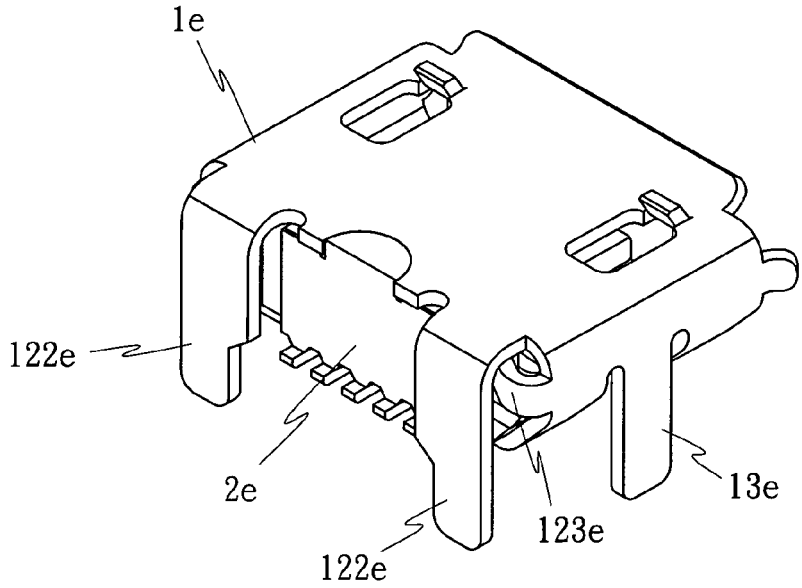
FIG. 13 is an elevational assembly view of the micro USB socket connector in accordance with the sixth embodiment of the present invention.

FIGS. 12 and 13 illustrate a micro USB socket connector in accordance with a sixth embodiment of the present invention. According to this sixth embodiment, the micro USB socket connector is comprised of a metal casing 1*e* and a plastic core member 2*e*. The plastic core member 2*e* of this sixth embodiment has two locating grooves 23*e* bilaterally disposed at the rear side. The metal casing 1*e* of this sixth embodiment comprises two long extension arms 122*e* backwardly extending from the top wall, two short extension arms 123*e* respectively backwardly extending from the two opposite lateral sidewalls, and two bonding strips 13*e* respectively downwardly extending from the two opposite lateral sidewalls. After insertion of the plastic core member 2*e* into the metal casing 1*e*, the short extension arms 123*e* are respectively bent inwards and engaged into the locating grooves 23*e* of the plastic core member 2*e*, and the long extension arms 122*e* are bent downwards to hold down the plastic core member 2*e* inside the metal casing 1*e*, and two bonding strips 13*e* are plugged into respective mounting through holes on a circuit board (not shown) and bonded thereto.

Figure 14:
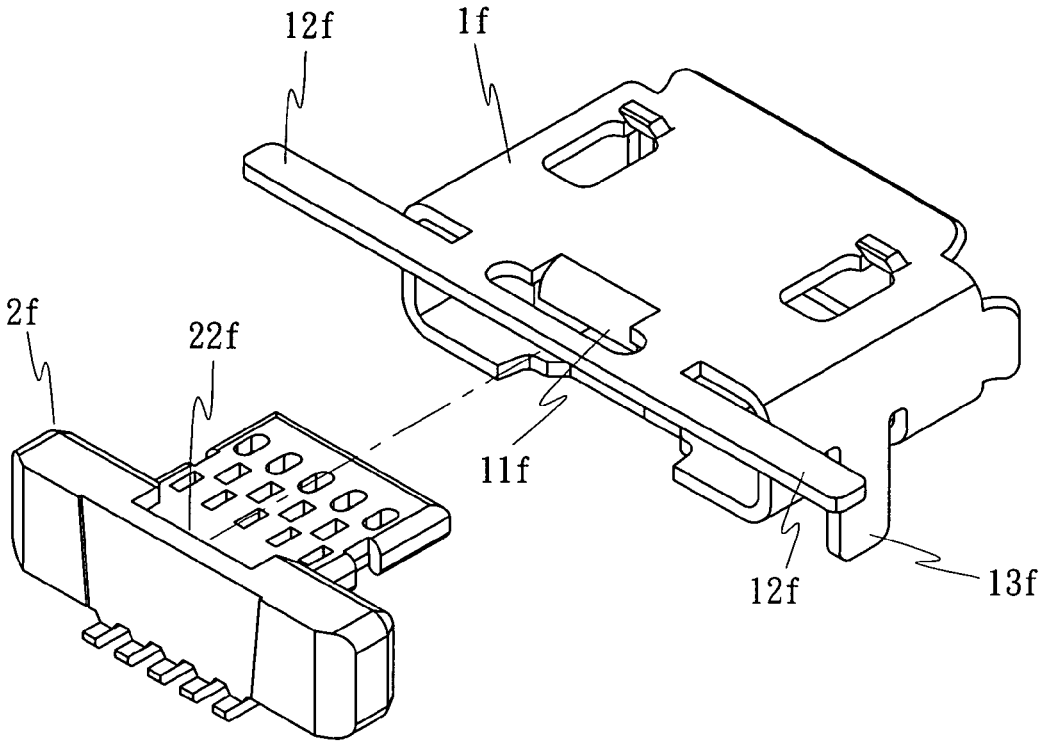
FIG. 14 is an exploded view of a micro USB socket connector in accordance with a seventh embodiment of the present invention.
Figure 15:
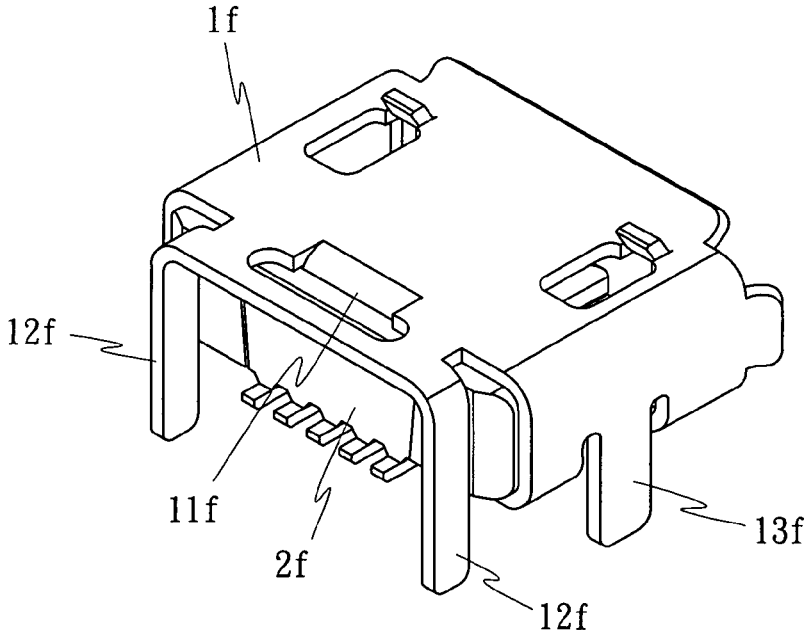
FIG. 15 is an elevational assembly view of the micro USB socket connector in accordance with the seventh embodiment of the present invention.

In the aforesaid 1st~7th embodiments, the first constraint device is a notch and the second constraint device is a raised portion. The first constraint device and the second constraint device can be respectively made in an alternate form for matching. FIGS. 14 and 15 illustrate a micro USB socket connector in accordance with a seventh embodiment of the present invention. According to this seventh embodiment, the micro USB socket connector is comprised of a metal casing 1*f* and a plastic core member 2*f*. The first constraint device 11*f* of the metal casing 1*f* is a downward protrusion 11*f* formed internally within the top wall. Punching a recessed hole on the top wall of the metal casing 1*f* forms the downward protrusion 11*f*. The second constraint device 22*f* of the plastic core member 2*f* is a recessed hole formed on the top wall. After insertion of the plastic core member 2*f* into the inside of the metal casing 1*f*, the downward protrusion 1*f* is forced into engagement with the recessed hole of the second constraint device 22*f* of the plastic cover member 2*f* to stop the plastic core member 2*f* from forward displacement relative to the metal casing 1*f*. The metal casing 1*f* further comprises extension arms 12*f* that are bent downwards to hold down the plastic core member 2*f* inside the metal casing 1*f*, and two bonding strips 13*f* for bonding to a circuit board (not shown). The design of the extension arms 12*f* and bonding strips 13*f* may be variously embodied as stated above.

Figure 16:
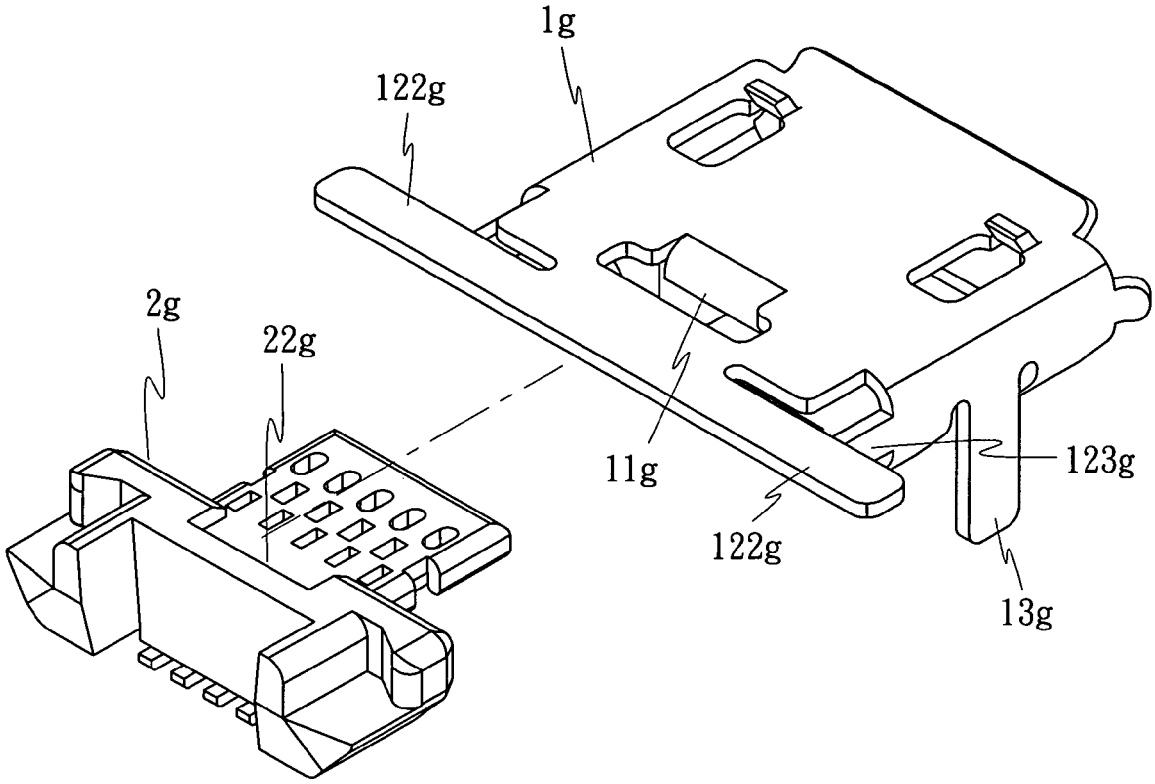
FIG. 16 is an exploded view of a micro USB socket connector in accordance with an eighth embodiment of the present invention.
Figure 17:
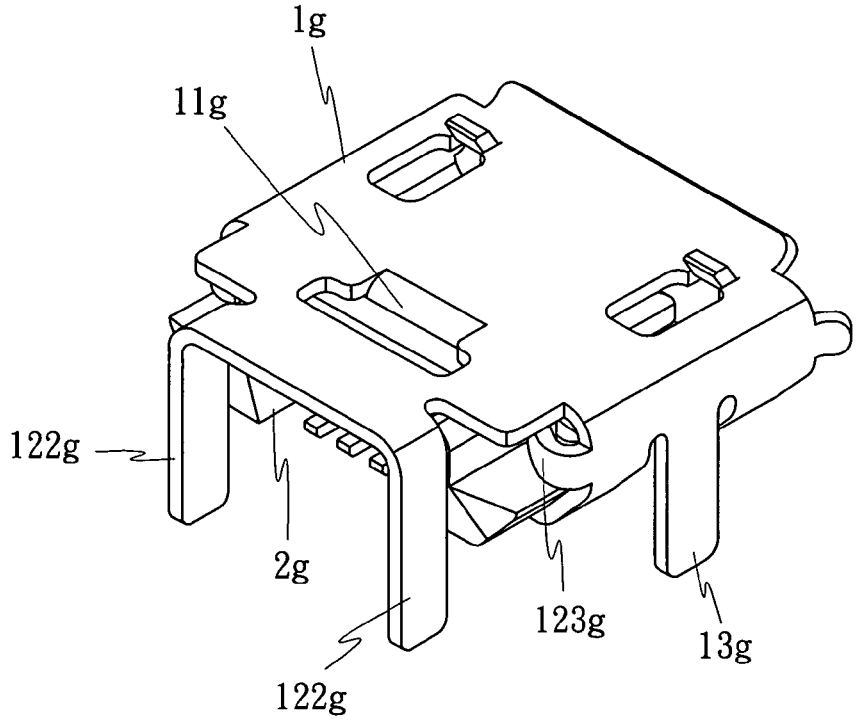
FIG. 17 is an elevational assembly view of the micro USB socket connector in accordance with the eighth embodiment of the present invention.

FIGS. 16 and 17 illustrate a micro USB socket connector in accordance with an eighth embodiment of the present invention. This embodiment is substantially similar to the aforesaid seventh embodiment, maintaining the first constraint device 11*g*, the second constraint device 22*g* and the bonding strips 13*g*. According to this eighth embodiment, the micro USB socket connector is comprised of a metal casing 1*g* and a plastic core member 2*g*. The metal casing 1*g* of this eighth embodiment further comprises transversely extending extension arms 122*g* and longitudinally extending extension arms 123*g* that are respectively bent downwards or inwards to hold down the plastic cover member 2*g* in the metal casing 1*g*.

Figure 18:
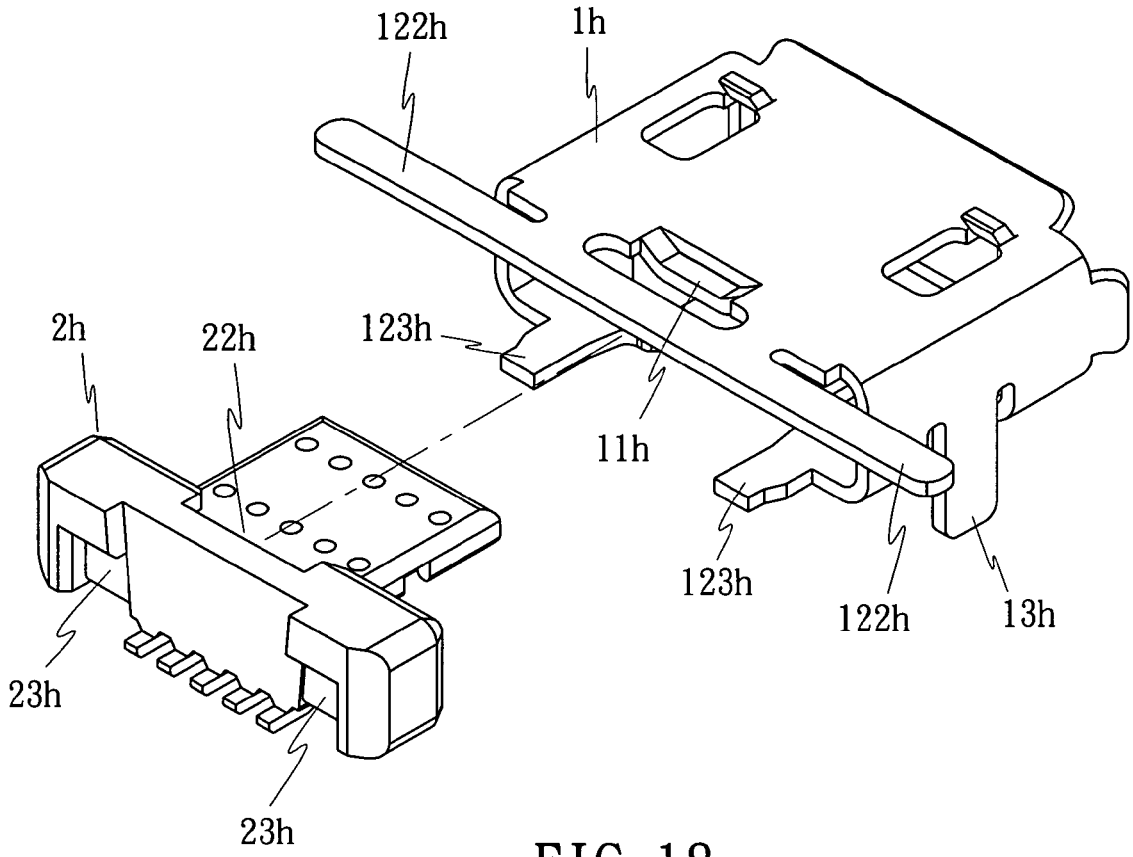
FIG. 18 is an exploded view of a micro USB socket connector in accordance with a ninth embodiment of the present invention.
Figure 19:
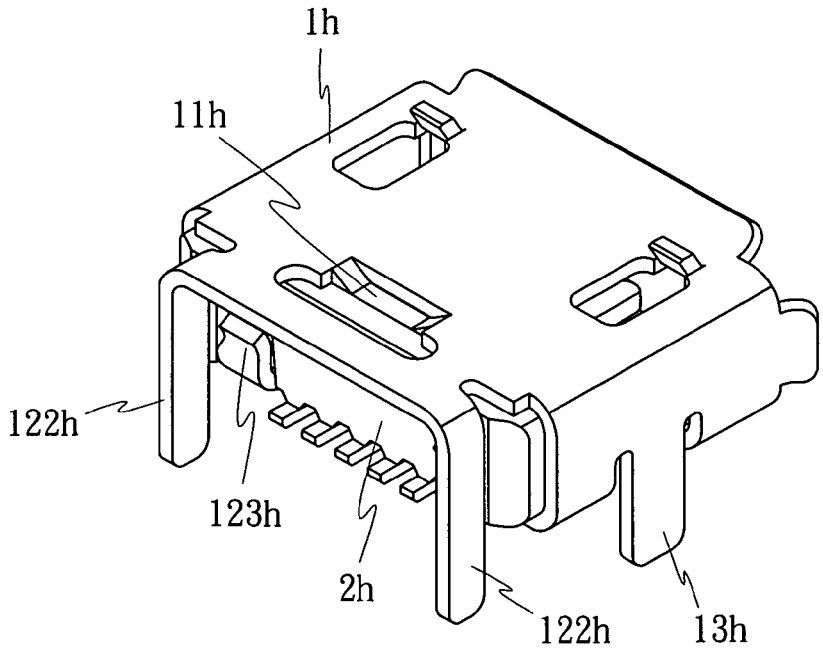
FIG. 19 is an elevational assembly view of the micro USB socket connector in accordance with the ninth embodiment of the present invention.

FIGS. 18 and 19 illustrate a micro USB socket connector in accordance with a ninth embodiment of the present invention. According to this ninth embodiment, the micro USB socket connector is comprised of a metal casing 1*h* and a plastic core member 2*h*. According to this ninth embodiment, the first constraint device 11*h* of the metal casing 1*h* is a downward protrusion for engaging the second constraint device 22*h* of the plastic core member 2*h* that is a recessed hole. The metal casing 1*h* further comprises two transversely extending extension arms 122*h*, two longitudinally extending extension arms 123*h*, and two downwardly extending bonding strips 13*h*. After insertion of the plastic cover member 2*h* into the metal casing 1*h*, the two longitudinally extending extension arms 123*h* are respectively bent upwards and engaged into the respective locating grooves 23*h* at the plastic core member 2*h*, and the two transversely extending extension arms 122*h* are respectively bent downwards to hold down the plastic cover member 2*h* in the metal casing 1*h* (see FIG. 19).

Further, the first constraint device 11*h* and the extension arms 123*h* as well as the bonding strips 13*h* may be variously embodied as stated above.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A micro USB socket connector comprising a metal casing, said metal casing having a front open side and a rear open side, and a plastic core member mounted in said metal casing, wherein: said plastic core member has a plurality of metal terminals embedded therein, and a second constraint device at the periphery thereof;

said metal casing comprises a first constraint device for engagement with said second constraint device of said plastic core member to hold said plastic core member in place, and a plurality of extension arms that are bent into shape to hold down said plastic core member in said metal casing after insertion of said plastic core member through said rear open side of said metal casing into the inside of said metal casing to force said second constraint device of said plastic core member into engagement with said first constraint device of said metal casing.

2. The micro USB socket connector as claimed in claim 1, wherein said second constraint device is a raised portion protruded from the periphery of said plastic core member, and said first constraint device is a notch formed on the periphery of said metal casing for receiving the raised portion of the first constraint device of said plastic core member.

3. The micro USB socket connector as claimed in claim 1, wherein said second constraint device is a recessed hole on a top wall of said plastic core member, and said first constraint device is a protrusion downwardly protruded from a top wall of said metal casing for engaging the recessed hole of the first constraint device of said plastic core member.

4. The micro USB socket connector as claimed in claim 1, wherein said extension arms respectively extend from two opposite lateral sidewalls of said metal casing in transverse direction.

5. The micro USB socket connector as claimed in claim 1, wherein said extension arms respectively and backwardly extend from two opposite lateral sidewalls of said metal casing in longitudinal direction.

6. The micro USB socket connector as claimed in claim 1, wherein said extension arms have a length shorter than the height and width of said metal casing.

7. The micro USB socket connector as claimed in claim 1, wherein said extension arms are longer than the height of said metal casing, each having a free end terminating in a reduced plug portion for bonding to a respective mounting through hole on a circuit board.

8. The micro USB socket connector as claimed in claim 1, wherein said metal casing comprises at least one bonding strip for bonding to a grounding terminal of a circuit board.

9. The micro USB socket connector as claimed in claim 1, wherein said extension arms are L-shaped bars respectively and backwardly from two opposite lateral sidewalls of said metal casing, each having a free end terminating in a reduced plug portion.

10. The micro USB socket connector as claimed in claim 1, wherein said plastic core member has two locating grooves bilaterally disposed at a rear side thereof for receiving said extension arms of said metal casing.

11. The micro USB socket connector as claimed in claim 1, wherein said metal casing has at least one mounting rod extending from a bottom wall thereof for mounting.

12. The micro USB socket connector as claimed in claim 11, wherein said at least one mounting rod each has an angled profile curving downwards.

13. The micro USB socket connector as claimed in claim 1, wherein said metal casing has two bonding strips respectively downwardly extending from two opposite lateral sidewalls thereof for bonding to an external circuit board.

14. The micro USB socket connector as claimed in claim 1, wherein said extension arms of said metal casing include a plurality of longitudinally extension arms and a plurality of transversely extension arms that are respectively bent downwards and inwards to hold down said plastic core member inside said metal casing after insertion of said plastic core member into the inside of said metal casing.

15. The micro USB socket connector as claimed in claim 1, wherein said casing has a part of a top wall thereof curved inwards to form said first constraint member, and said plastic core member has a part of a top wall thereof curved outwards to form said second constraint member for engagement with said first constraint member.

16. The micro USB socket connector as claimed in claim 1, wherein said extension arms extend from a bottom wall of said metal casing below said rear open side.

17. The micro USB socket connector as claimed in claim 1, wherein said extension arms include at least one first extension arm and at least one second extension respectively extending from top and bottom walls of said metal casing that are respectively bent downwards and upwards to hold down said plastic core member inside said metal casing after insertion of said plastic core member into the inside of said metal casing.

* * * * *